US005921027A

United States Patent [19]

Siebenahler

[11] Patent Number: 5,921,027

[45] Date of Patent: Jul. 13, 1999

[54] ADJUSTABLE GATE

[76] Inventor: Lyle M. Siebenahler, R.R. 3, Box 171, Pipestone, Minn. 56164

[21] Appl. No.: 08/813,110

[22] Filed: Mar. 7, 1997

[51] Int. Cl.[6] ..... E06B 11/02

[52] U.S. Cl. ..... 49/160

[58] Field of Search ..... 49/55, 158, 159, 49/160, 381, 382, 396; 16/243, 86.1, 86.2

[56] References Cited

U.S. PATENT DOCUMENTS

| | | | |
|---|---|---|---|
| 717,330 | 12/1902 | Bowsher | 49/159 |
| 915,407 | 3/1909 | Baumgartner | 49/158 |
| 1,116,867 | 11/1914 | Anderson | 49/160 |
| 1,168,233 | 1/1916 | Tausch | 49/160 |
| 1,224,087 | 4/1917 | Flory | 49/160 |
| 1,233,225 | 7/1917 | Hardwick | 49/160 |
| 2,585,152 | 2/1952 | Merchant | 49/160 |
| 3,751,084 | 8/1973 | Lening | 49/231 |

FOREIGN PATENT DOCUMENTS

| | | | |
|---|---|---|---|
| 171846 | 9/1916 | Canada | 49/160 |

*Primary Examiner*—Daniel P. Stodola
*Assistant Examiner*—Curtis Cohen
*Attorney, Agent, or Firm*—Nawrocki, Rooney & Sivertson, P.A.

[57] ABSTRACT

A gate for livestock having an adjustable height. The gate has one or more hinges which allow an operator to raise or lower the gate to a number of positions. The hinges are securely attached to a rigidly mounted structure and slidably support the gate. Each hinge has a spring-loaded handle which engages one of a number of holes in the gate. The spring-loaded handle can be preset in one of two positions where a first position allows the gate to be raised but not lowered and the second position allows the gate to be lowered but not raised. Once the gate is raised or lowered to the desired position, the handle is set to the first position.

5 Claims, 4 Drawing Sheets

ADJUSTABLE GATE

TECHNICAL FIELD

This invention relates to an apparatus for adjusting the height of a gate to a fence. More particularly it relates to an adjustable gate for livestock having an adjustable height wherein one or more hinges are provided which allow an operator to raise or lower the gate to number of positions. Each hinge slidably supports the gate and has a spring-loaded handle which can be preset in a first position to allow the gate to be raised but not lowered, or to a second position to allow the gate to be lowered but not raised.

BACKGROUND OF THE INVENTION

Gates have been used as a means of providing access for closed or fenced-in areas for a long time. With outdoor applications, gates have been used in a variety of circumstances required different features depending on the application. One application is to provide access to areas where livestock are kept. Typically these types of applications utilize metal gates having two or more hinges. The hinges allow the gate to swing to an open or closed position to either allow livestock to pass or to keep the livestock in the enclosed area. When the gate is installed on the fence, the height of the gate is preset to provide clearance for the ground underneath the gate. The hinges are bolted to both the fence and the gate.

With any outdoor application, a buildup of snow underneath the gate may prevent the gate from being opened or closed. If a substantial accumulation of snow occurs, access to the enclosed area may not be easily obtainable until the snow buildup is cleared. With livestock, the buildup of snow is still a problem, but additional problems also exist. Often times manure buildup occurs which prevents the gate from being opened or closed. Manure buildup occurs on a daily basis, and may impact the utility of the gate until the manure buildup is cleared. Yet another problem is fence-jumping. This may be problematic with large animals such as horses. Often times spirited horses may be kept for a period of time. Typically fences used to keep these horses are electrified to discourage contact or jumping. For safety reasons however, the gate of the fence is not electrified. The spirited horse thus may be eventually encouraged to attempt to jump the gate.

In the past gates used for these applications were not easily adjustable. The bolts used to attach the two or more hinges to the gate and to the fence had to be loosened or removed with wrenches to allow repositioning of the gate. Depending on the design of the gate, clearance of the structure of the gate with the hinge often times necessitated removal of the hinge for placement in a more optimal location. This process had to be repeated for repositioning of the gate back to the initial position. Unfortunately, for livestock applications, this process was repeated on a daily or weekly basis. Adverse weather conditions, such as extremely high or low temperatures, and rain or snow, made the gate adjustment process more difficult or impossible.

SUMMARY OF THE INVENTION

Accordingly, it is an object of the invention to provide a gate for livestock having an adjustable height, wherein the gate has one or more hinges which allow an operator to quickly and easily raise or lower the gate to a number of positions. The hinges are securely attached to a rigidly mounted structure such as a fence and slidably support the gate. Each hinge has a spring-loaded handle which engages one of a number of holes in the gate. The spring-loaded handle can be preset in one of two positions, where a first position allows the gate to be raised, but not lowered, and the second position allows the gate to be lowered, but not raised. Once the gate is raised or lowered to the desired position, the handle is set to the second position.

In a preferred embodiment of the present invention, an apparatus for adjusting the height of a gate on a fence is provided which has a vertical elongate beam, a number of height adjustment apparatus, and a number of hinges. The vertical elongate beam has a length which is greater than the range of adjustment of the height of the gate, wherein the beam is securely attached to the gate at a top end and at a bottom end to support the weight of the gate. Each one of the number of height adjustment apparatus is slidably attached to the beam and removably engages the beam to hold the height adjustment apparatus at a position within the range of adjustment. Each one of the number of hinges is securely mounted to a corresponding one of the number of height adjustment apparatus to hingedly attach the particular one of the number of height adjustment apparatus to the fence.

In the preferred embodiment, the height adjustment apparatus comprises a sleeve which is slidably attached to the beam and slides over the beam. The height adjustment apparatus further comprises a handle having a first portion and a second portion, and a bracket mounted to an exterior of the sleeve. The bracket slidably receives the first portion of the handle through an opening wherein the first portion is received in a direction perpendicular to the length of the beam. A distal end of the first portion of the handle that may removably engage one of the number of openings within the beam through a hole within the sleeve. The number of openings within the beam are positioned along the length of the beam so that when the sleeve is moved along the length of the beam, the distal end of the first portion of the handle can be aligned with and engage any one of the number of openings. The height adjustment apparatus further provides a stopping means which is a pin adjacent to the distal end of the first portion of the handle and which is mounted perpendicular to the direction which is perpendicular to the length of the beam. The length of the pin is greater than a thickness of the first portion of the handle. The height adjustment apparatus further comprises a positioning means which is a collar attached to the exterior of the sleeve for slidably receiving the distal end of the first portion of the handle to align the first portion of the handle with any one of the number of openings. The collar has a number of slots to removably receive a portion of the length of the pin greater than the thickness of the first portion of the handle. The number of slots maintain a rotational alignment of the first portion of the handle in either a first position or a second position. The first position has an angular displacement relative to the second position of 180°. The second portion of the handle provides means to rotate the first portion of the handle to the first position or the second position. The height adjustment apparatus further comprises a spring which is positioned over the first portion of the handle where the spring has a bore sufficiently large to receive the first portion of the handle. The spring is located between a surface of the bracket adjacent the opening where the bracket slidably receives the first portion of the handle, and between the pin. The spring urges the distal end of the first portion of the handle to removably engage one of the number of openings. The distal end of the first portion of the handle prevents the beam from moving in a second direction when the handle is in a first position or from moving in a first direction when the handle is in a second position. The distal end of the first portion of the handle has a surface with a slope sufficient to impart a return urging force to compress the spring when the handle is in a first position and the beam is being moved in a first direction so that the distal end of the first portion of the handle may be moved from one of the number of openings to the next one of the number of openings. The return urging force may likewise compress the spring when the handle is in a second position and the beam is being moved in a second direction so that the distal end of the first portion of the handle may be moved from one of the number of openings to another one of the number of openings. In the preferred embodiment, each one of the number of hinges comprises a hinge bracket and a rod. The hinge bracket is securely attached to the sleeve and has a bore with an axis parallel to the length of the beam. The rod has a first threaded section and a second section. The first threaded section is threadably attached to the fence. The second section extends upwardly and is rotatably received by the bore so that the sleeve is hingedly attached to the fence. In the preferred embodiment, the handle is a rod having a 90° bend between the first portion and the second portion. The 90° bend provides the mechanical advantage for the second portion to compress the spring and withdraw the portion of the length of the pin from the number of slots and rotate the first portion of the handle 180° from the first position to the second position or from the second position to the first position. An external force is applied to the first portion of handle to provide the mechanical force necessary to compress the spring and rotate the first portion of the handle. In the preferred embodiment, the return urging force required to compress the spring when the handle is in the first position and the beam is being moved in the first direction, or when the handle is in the second position and the beam is being moved in the second direction is greater than an urging force imparted by the weight of the gate.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
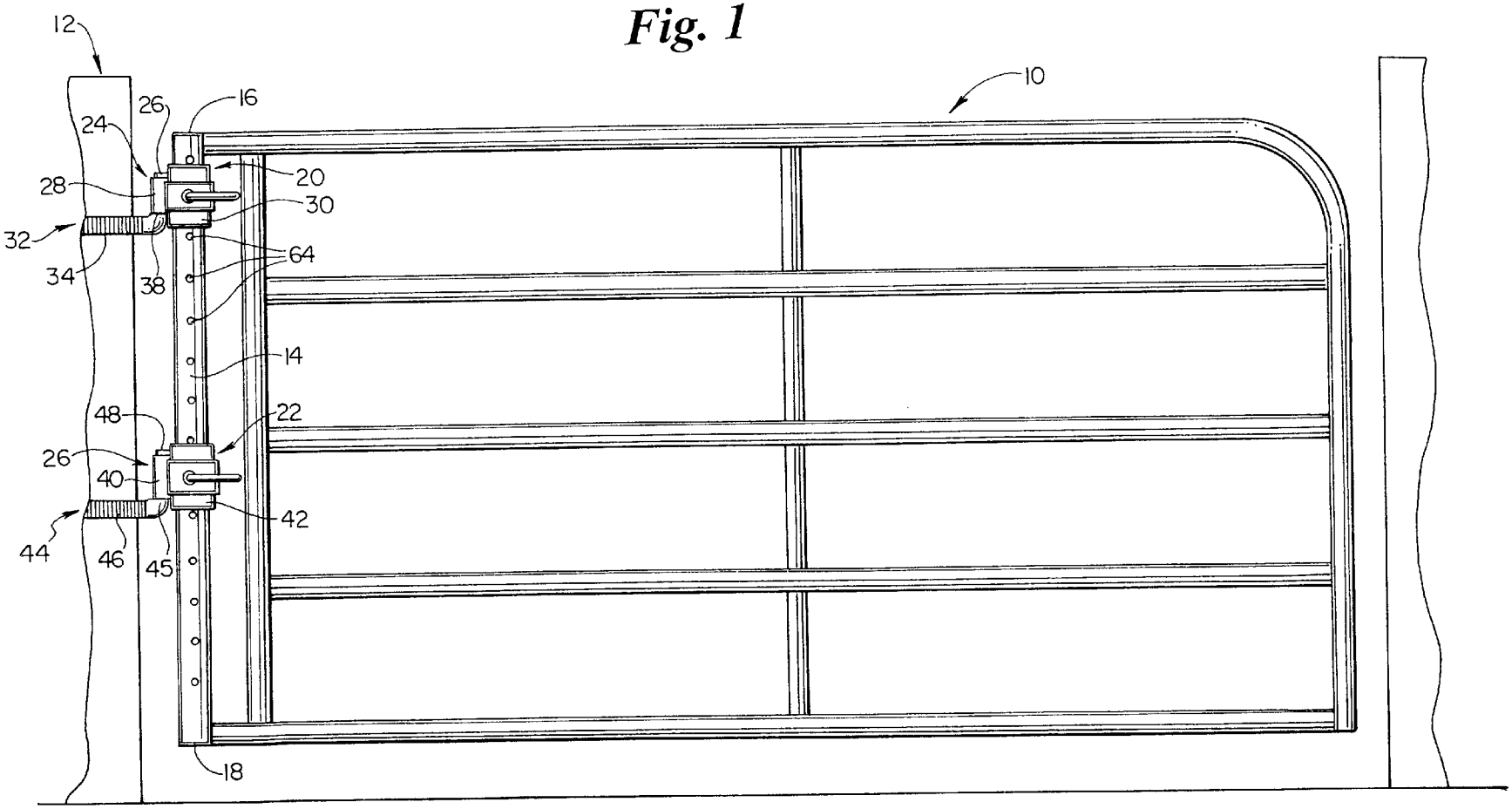
FIG. 1 is a perspective view of the "Adjustable Gate" invention.

Referring now to the drawings, wherein like reference numerals refer to like elements throughout the several views, FIG. 1 is a perspective view of the adjustable gate invention. FIG. 1 shows generally a gate 10 and a fence 12. Gate 10 is securely attached to beam 14 at a top end 16 and a bottom end 18 to support the weight of the gate. Beam 14 has a length between top end 16 and bottom end 18 which is greater than a range of adjustment of the height of the gate. FIG. 1 shows height adjustment apparatus 20 and height adjustment apparatus 22 which are each slidably attached to beam 14. Height adjustment apparatus 20 and height adjustment apparatus 22 each have a range of adjustment along beam 14 approximately equal to a difference between top end 16 and bottom end 18 and a distance between height adjustment apparatus 20 and height adjustment apparatus 22. Height adjustment apparatus 20 and height adjustment apparatus 22 each removably engage beam 14 to hold respectively at a position within the range of adjustment. FIG. 1 further shows a hinge 24 and a hinge 26, wherein hinge 24 and hinge 26 are securely mounted to height adjustment apparatus 20 and height adjustment apparatus 22, respectively. Hinge 24 and hinge 26 are also mounted to fence 12 to hingedly attach height adjustment apparatus 20 and height adjustment apparatus 22 to fence 12. Hinge 24 is comprised of hinge bracket 28 which is securely attached to a sleeve 30 of height adjustment apparatus 20. Hinge bracket 28 has a bore having an axis which is parallel to the length of beam 14 between top end 16 and bottom end 18. Hinge 24 is further comprised of a rod 32 having a first threaded section 34 and a second section 36, where the first threaded section 34 is threadably attached to fence 12, and the second section 36 extends upwardly to be received by bore 38 of hinge bracket 28 so that sleeve 30 is hingedly attached to fence 12. Hinge 26 is comprised of a hinge bracket 40 securely attached to a sleeve 42. Sleeve 42 has a bore 45 with an axis parallel to the length of beam 14 between top end 16 and bottom end 18. Hinge 26 is further comprised of a rod 44 having a first threaded section 46 and a second section 48. First threaded section 46 is threadably attached to fence 12 and second section 48 extends upwardly and is rotatably received by bore 45 so that sleeve 42 is hingedly attached to fence 12.

Figure 2:
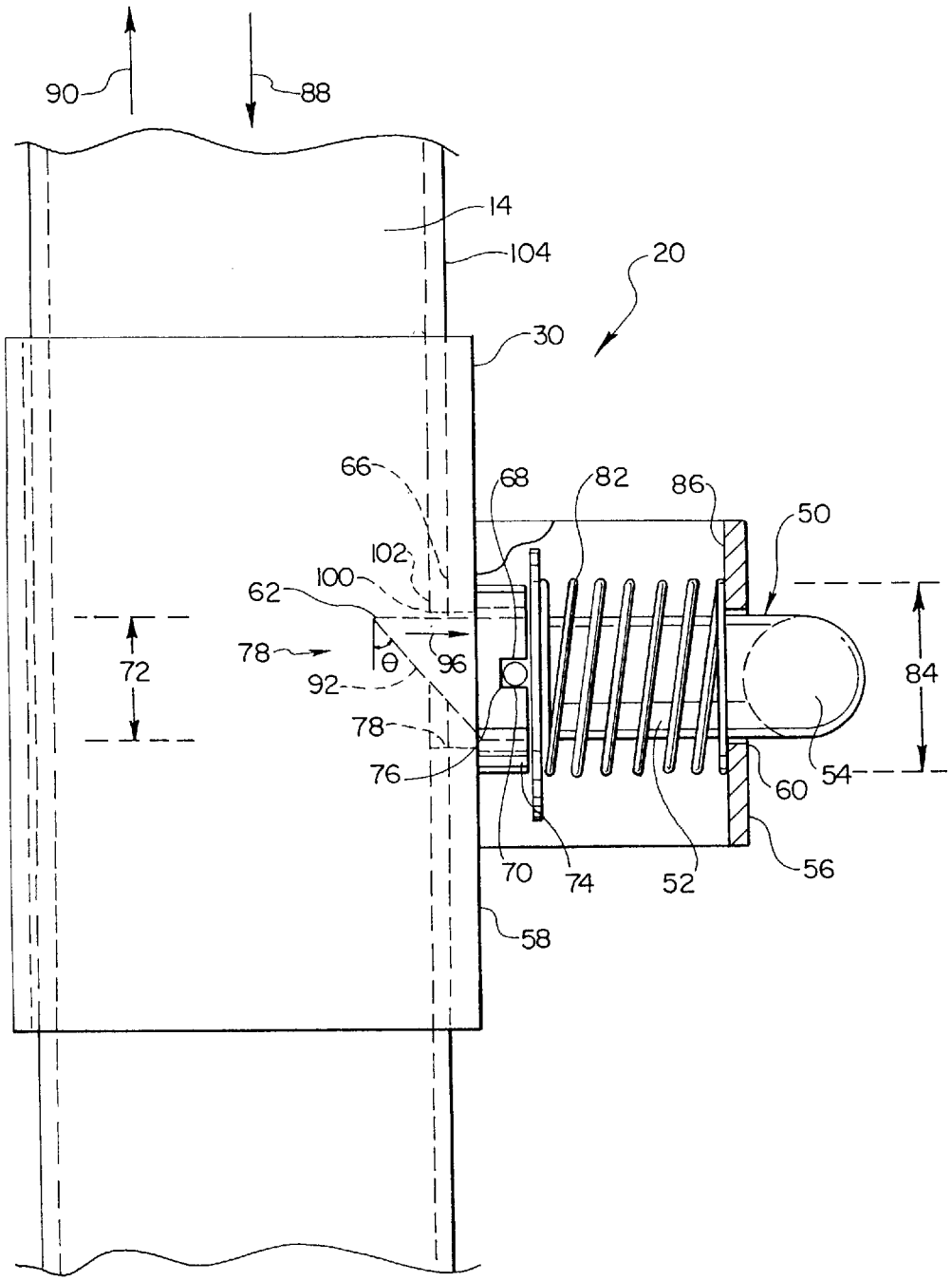
FIG. 2 is a detailed cross-section view showing the height adjustment apparatus of a preferred embodiment of the present invention.

FIG. 2 is a detailed cross-sectional view showing the height adjustment apparatus of a preferred embodiment of the present invention. FIG. 2 shows height adjustment apparatus 20. Height adjustment apparatus 20 has a sleeve 30 slidably attached to beam 14 to slide over beam 14 along the length of beam 14 within the range of adjustment. Height adjustment apparatus 20 further has a handle 50 having a first portion 52 and a second portion 54. Height adjustment apparatus 20 further has a bracket 56 which is mounted to an exterior 58 of sleeve 30 to slidably receive first portion 52 of handle 50 through an opening 60 in a direction perpendicular to the length of beam 14. A distal end 62 of first portion 52 of handle 50 removably engages one of the number of openings 64 within beam 14 through a hole 66 within sleeve 30 (see also, FIG. 1). The number of openings 64 within beam 14 are positioned along the length of beam 14 so that when sleeve 30 is moved along the length of beam 14, distal end 62 of first portion 52 of handle 50 is aligned with and engages any particular one of the number of openings 64 (see also, FIG. 1). Height adjustment apparatus 20 is further comprised of a stopping means which is a pin 68 adjacent distal end 62 of first portion 52 of handle 50. Pin 68 is mounted perpendicular to a direction perpendicular to the length of beam 14 between top end 16 and bottom end 18. Pin 68 further has a length 70 which is greater than a thickness 72 of first portion 52 of handle 50. Height adjustment apparatus 20 is further comprised of a positioning means which is a collar 74 attached to exterior 58 of sleeve 30 for slidably receiving distal end 62 of first portion 52 of handle 50 to align first portion 52 with any one of the number of openings 64. The collar further is comprised of a number of slots 76 to removably receive a portion of length 70 of pin 68 which is greater than a thickness 72 of first portion 52 of handle 50. The slots 76 maintain rotational alignment of first portion 52 of handle 50 in a first position 78 or a second position 80. FIG. 2 shows handle 50 in first position 78. First position 78 has an angular displacement relative to second position 80 of 180° about an axis of first portion 52 of handle 50 which is perpendicular to the length of beam 14. Second portion 54 of handle 50 provides means to rotate first portion 52 of handle 50 to either the first position 78 or the second position 80. Height adjustment apparatus 20 is further comprised of a spring means which is a spring 82 positioned over first portion 52 of handle 50. Spring 82 has a bore 84 sufficiently large to receive first portion 52 of handle 50. Spring 82 is located between a surface 86 of bracket 56, adjacent opening 60, where bracket 56 slidably receives first portion 52 of handle 50, and between pin 68. Spring 82 urges distal end 62 of first portion 52 of handle 50 to removably engage a one of the number of openings 64. In FIG. 2 opening 100 is engaged. Distal end 62 of first portion 52 of handle 50 prevents beam 14 from moving in a second direction 88 when handle 50 is in a first position 78, or from moving in a first direction 90 when handle 50 is in a second position 80. Distal end 62 of first portion 52 of handle 50 has a surface 92 with slope 94 sufficient to impart a return urging force in a direction of arrow 96 to compress spring 82 when handle 50 is in a first position 78 and beam 14 is being moved in a first direction 90 so that distal end 62 of first portion 52 of handle 50 may be moved from one of the number of openings 64 to a next one of the number of openings 64. When handle 50 is in a second position 80 and beam 14 is being moved in a second direction 88, distal end 62 of first portion 52 of handle 50 may be moved from one of the number of openings 64 to another next one of the openings 64. The return urging force is imparted in the direction of arrow 96 when handle 50 is in first position 78 and beam 14 is moved in first direction 90 due to surface 92, which has an angle θ with respect to the longitudinal axis of beam 14, contacting edge 98 of opening 100 to cause compression of spring 82 in the direction of arrow 96. Conversely, if handle 50 is in second position 80 and beam 14 is moved in second direction 88, surface 92 of distal end 62 of first portion 52 of handle 50 contacts edge 102 to impart a return urging force in the direction of arrow 96 to compress spring 82. Spring 82 is compressed once distal end 62 is outside of opening 100 and riding on surface 104 of beam 14, and first portion 52 of handle 50 may then be moved to a next one of the number of openings 14 (not shown) to removably engage that opening. In the preferred embodiment, the return urging force required to compress spring 82 when handle 50 is in first position 78, and beam 14 is being moved in first direction 90, or when handle 50 is in second position 80 and beam 14 is being moved in second direction 88, is greater than the urging force imparted by the weight of the gate. In the preferred embodiment, external force is required to provide the return urging force in the direction of arrow 96 for spring 82. In the preferred embodiment, handle 50 is a rod having a 90° bend between first portion 52 and second portion 54. The 90° bend provides a mechanical advantage for external actuation for second portion 54 to compress spring 82 and withdraw the portion of the length 70 of pin 68 from slot 76 and rotate first portion 52 of handle 50 180° degrees from first position 78 to second position 80, or from second position 80 to first position 78.

Figure 3:
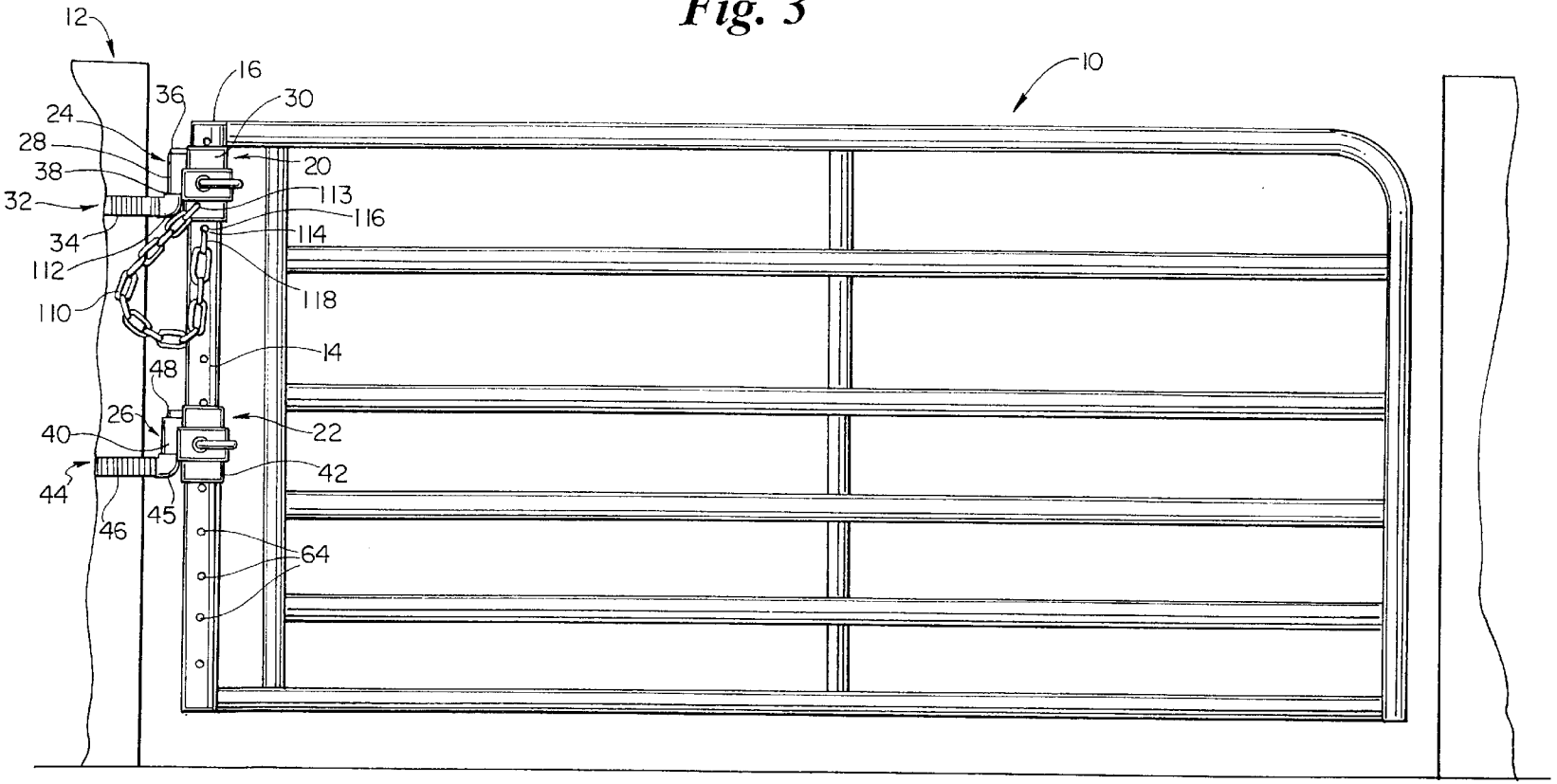
FIG. 3 is a perspective view of an alternate embodiment of the present invention.

FIG. 3 shows a perspective view of an alternative embodiment of the present invention. FIG. 3 is in all respects the same as FIG. 1, but shows in addition a safety chain 110 coupled between sleeve 30 and beam 14. Safety chain 110 is hingedly attached to sleeve 30 via a hingeable connection of link 112 of safety chain 110 through hole 113 of sleeve 30. Safety chain 110 is further hingedly attached to a safety pin 116 via a hingeable connection between link 118 of safety chain 110 and a hole 121 within tab 122 of safety pin 116 (see also, FIG. 4).

Figure 4:
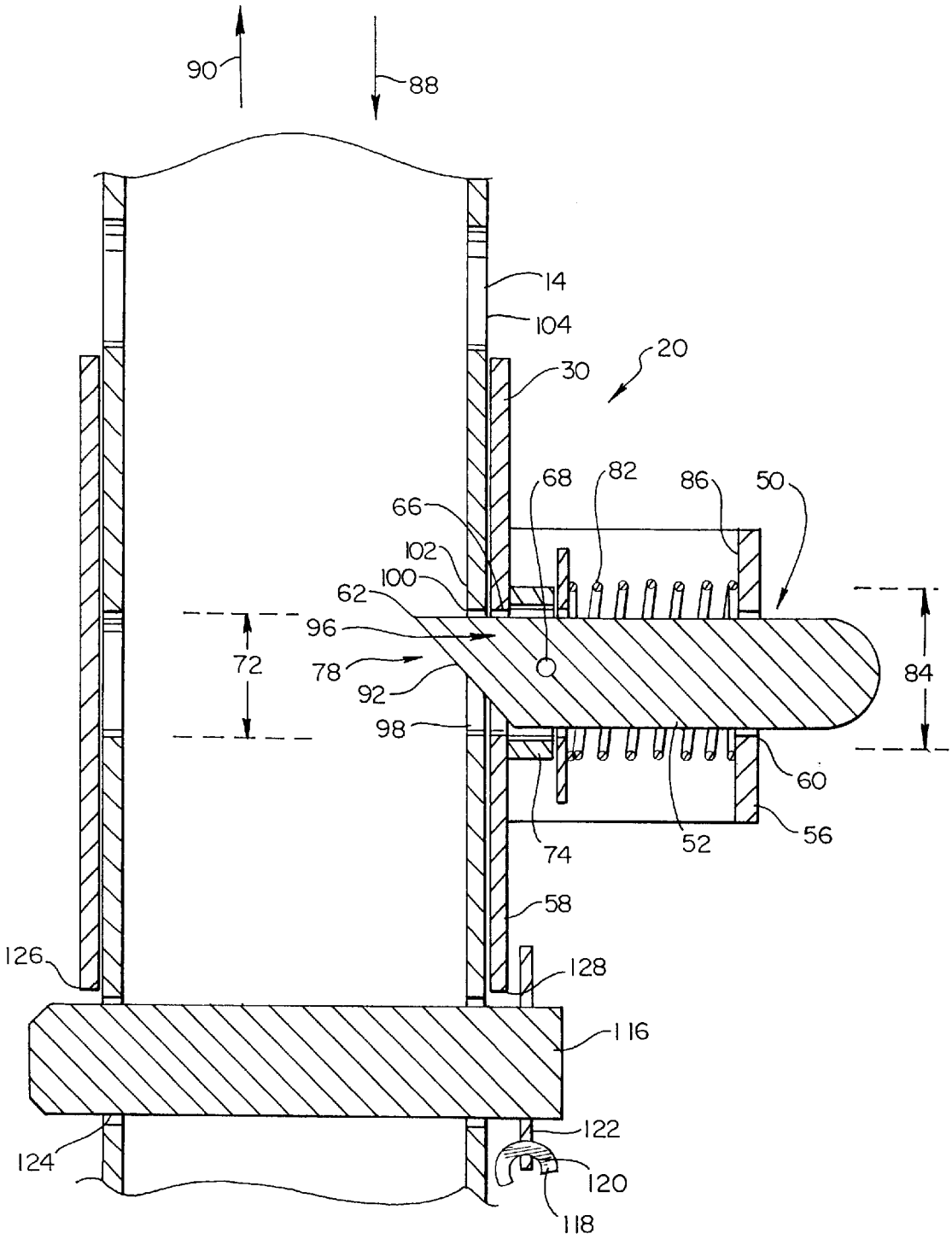
FIG. 4 is a detailed cross-section view showing the safety pin of the alternate embodiment of the present invention.

FIG. 4 is a detailed cross-sectional view showing the safety pin of the alternative embodiment of the present invention. Safety pin 116 is inserted through opening 124 of beam 14. Safety pin 116 supports sleeve 30 at a lower end 126 and lower end 128 so that if first portion 52 disengages opening 124 that support for gate 10 is provided. FIG. 4 shows link 118 of safety chain 110 coupled to tab 122 of safety pin 116 through hole 121 to hingedly attach to safety pin 116. Safety pin 116 may be inserted in any one of the number of openings 64 of beam 14. The height adjustment apparatus 20 in FIG. 4 is in all other respects equivalent to the height adjustment apparatus 20 of FIG. 2.

Having thus described the preferred embodiments of the present invention, those of skill in the art will readily appreciate that yet other embodiments may be made and used within the scope of the claims hereto attached.

What is claimed:

1. In combination with a gate to be mounted on a fence:

a. a vertical elongate beam having a length, extending along a longitudinal axis thereof, which is greater than a range of adjustment of the height of the gate, said beam being securely attached to the gate;

b. a sleeve disposed to slide over said beam along at least a portion of said length for a distance equal to said range of adjustment;

c. a handle having a first portion;

d. a bracket mounted to an exterior of said sleeve to slidably dispose said first portion of said handle for reciprocation in a direction perpendicular to said longitudinal axis of said beam, a distal end of said first portion of said handle removably engaging one of a number of openings spaced axially along said beam as said first portion reciprocates through a hole within said sleeve, said openings spaced alone said beam so that, when said sleeve is moved along said beam, said distal end of said first portion of said handle can be registered with, and engage, any one of said openings;

e. a pin mounted to said first portion of said handle extending perpendicular to said direction perpendicular to said length of said beam, said pin extending radially from said first portion of said handle;

f. a collar, attached to said exterior of said sleeve substantially coaxial with said hole, for receiving therethrough said first portion of said handle, said collar having a pair of slots, each slot to removably receive said pin therein, each of said slots maintaining a rotational alignment of said first portion of said handle in one of a first position and a second position, said first position having an angular displacement relative to said second position of 180°;

g. a spring to urge said distal end of said first portion of said handle to removably engage said one of said number of openings, said distal end of said first portion of said handle preventing said beam from moving in a second direction when said handle is in a first position or from moving in a first direction when said handle is in a second position; and h. a hinge securely mounted to said sleeve to hingably attach said sleeve to said fence.

2. The combination according to claim 1 wherein the hinge comprises:

a a hinge bracket attached to the sleeve and having a bore with an axis parallel to said longitudinal axis of said beam; and b. a rod attached to said fence, extending upwardly and rotatably received within said bore.

3. The combination according to claim 1 wherein the handle is a rod having a 90° bend between the first portion and a second portion, said second portion at said 90° bend providing the mechanical advantage to compress said spring and withdraw the pin from a slot and rotate said first portion of said handle 180° from the first position to the second position and back.

4. The combination according to claim 1 wherein return urging force required to compress the spring, when the handle is in the first position and the beam is being moved in the first direction or when the handle is in the second position and said beam is being moved in the second direction, is greater than an urging force imparted by the weight of the gate.

5. In combination with a gate to be mounted on a fence:

a. an elongate beam having a generally vertically-extending longitudinal axis when in an intended disposition relative to the fence when the gate is mounted on the fence, said beam mounting the gate thereto;

b. a sleeve encircling said beam and disposed to slide along said beam;

c. a hinge securely mounting said sleeve to said fence;

d. a handle having a first portion, said handle cooperating with said sleeve for reciprocating movement through a hole within said sleeve and in directions generally perpendicular to the longitudinal axis of said beam, said handle being rotated between a first position and a second position, a distal end of said handle first portion defining an angled surface which, when said handle first portion is in said first rotational position, slopes downwardly and outwardly relative to said beam and, when said handle first portion is in said second rotational position, slopes upwardly and outwardly with respect to said beam;

e. means for biasing said handle first portion inwardly relative to said beam to pass through one of a number of openings spaced axially along said beam; and f. means for locking said handle first portion selectively in one of said first and second rotational positions.

* * * * *